United States Patent [19]

Stanley

[11] 3,938,225

[45] *Feb. 17, 1976

[54] ROTARY APPARATUS FOR CRIMPING STRANDS

[75] Inventor: Robert K. Stanley, Media, Pa.

[73] Assignee: Textured Yarn Co., Inc., Kennett Square, Pa.

[ * ] Notice: The portion of the term of this patent subsequent to Jan. 1, 1991, has been disclaimed.

[22] Filed: Sept. 3, 1974

[21] Appl. No.: 502,493

Related U.S. Application Data

[63] Continuation of Ser. No. 376,567, July 5, 1973, abandoned, which is a continuation-in-part of Ser. No. 176,029, Aug. 30, 1971, Pat. No. 3,781,951.

[52] U.S. Cl. ..... 28/1.6; 57/77

[51] Int. Cl.[2] ..... D02G 1/12

[58] Field of Search ..... 28/1.6, 1.7, 72.12, 72.14; 57/76, 77; 206/64, 118, 119; 226/118, 119; 242/128, 163

[56] References Cited

UNITED STATES PATENTS

| | | | |
|---|---|---|---|
| 1,732,526 | 10/1929 | Mumford | 57/77 |
| 1,986,433 | 1/1935 | Harrison | 57/76 |
| 1,990,617 | 2/1935 | Sanders et al. | 57/76 X |
| 2,042,529 | 6/1936 | Huttinger | 57/76 X |
| 2,338,539 | 1/1944 | Quinlan | 242/128 |
| 2,574,455 | 11/1951 | Abbott | 242/128 X |
| 3,156,028 | 11/1964 | Weiss et al. | 28/72.14 X |
| 3,438,101 | 4/1969 | LeNoir et al. | 28/1.6 |
| 3,781,951 | 1/1974 | Stanley | 28/1.6 |

FOREIGN PATENTS OR APPLICATIONS

| | | | |
|---|---|---|---|
| 282,546 | 2/1931 | Italy | 57/77 |

*Primary Examiner*—Robert R. Mackey
*Attorney, Agent, or Firm*—Charles A. McClure

[57] ABSTRACT

Textile strands are compressively crimped by propelling them lengthwise, as by a fluid jet, into a rotating cylindrical chamber having a foraminous surface. Rotation of the chamber aids in collection and temporary retention of the crimped strand until it is withdrawn therefrom at the leading edge of the strand accumulation after about half a revolution. The crimped strand is withdrawn between an edge of the chamber and an adjacent solid surface rotating therewith, as by conical rolls.

5 Claims, 8 Drawing Figures

Fig. 1.
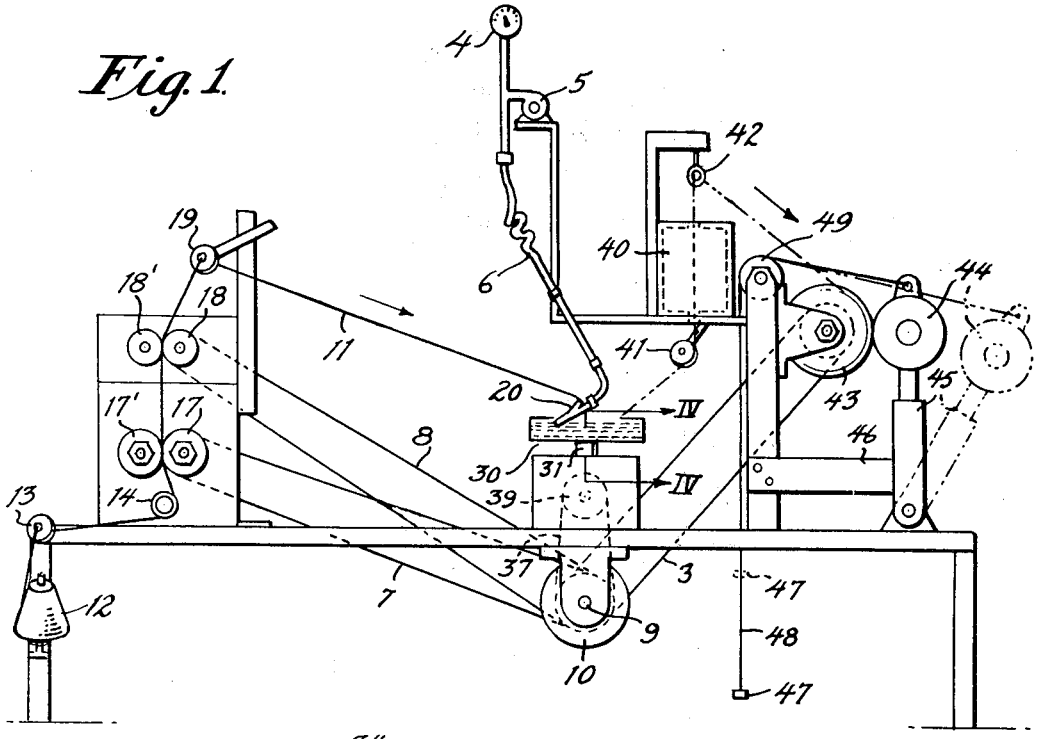
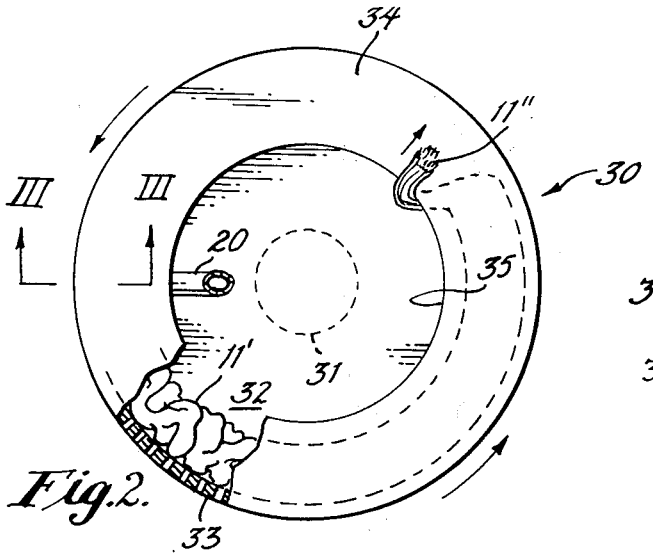
Fig. 2.
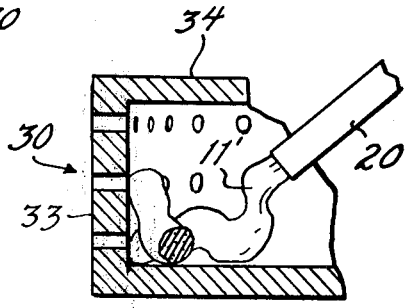
Fig. 3.
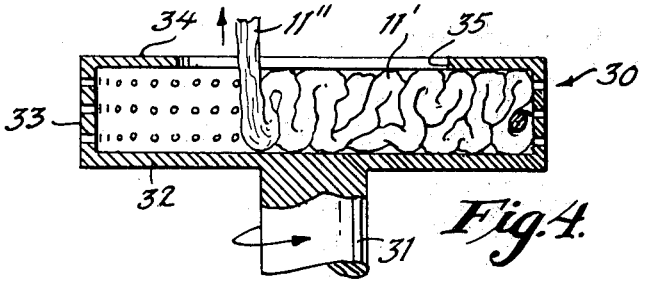
Fig. 4.

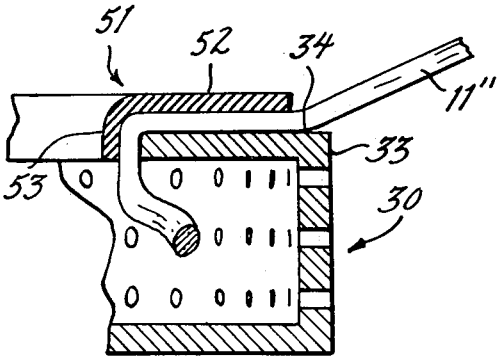
Fig. 6.
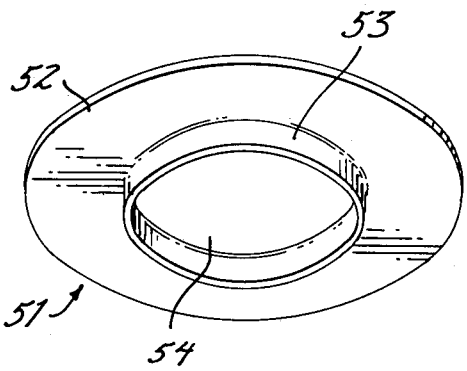
Fig. 5.
Fig. 7.
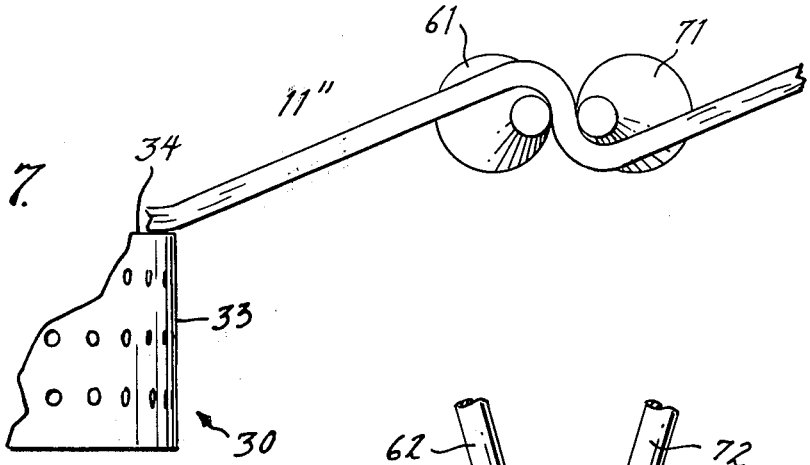
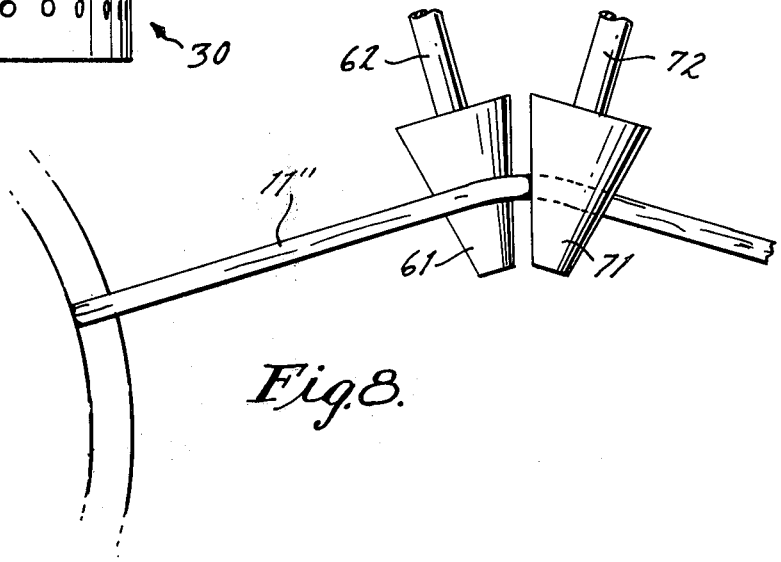
Fig. 8.

ROTARY APPARATUS FOR CRIMPING STRANDS

This is a continuation of my copending application Ser. No. 376,567 filed July 5, 1973 and since abandoned, which was a continuation-in-part of my copending application, Ser. No. 176,029 filed Aug. 30, 1971 and now U.S. Pat. No. 3,781,951.

This invention relates to the compressive crimping of textile strands, as by propelling such a strand lengthwise into buckling contact against a flat or smooth surface and accumulating it in resulting crimped configuration on an adjacent foraminous strand-supporting surface.

In conventional techniques for compressive crimping of textile strands, such a strand to be crimped usually is forced lengthwise into one end of a tubular enclosure by feed rolls, although sometimes by fluid transport, to buckle as it then comes into contact with an accumulation of the same strand previously forced thereinto, after which the crimped strand is withdrawn from the leading edge of the strand accumulation by being wound up out of the opposite end of the enclosure. Such technique suffers from throughput limitations, and the parts of the strand that slide along the enclosure wall often exhibit different physical characteristics, such as a noticeable dyeability differential, as compared with the rest of the crimped strand. It is also known to propel strands against a foraminous barrier or screen to compress them longitudinally, but such impact is deleterious to strand components, being conducive to breaking thereof. Also, openings in such screens or barriers tend to snag fine filaments or fibrils and to fill up with fibrous and particulate matter. Another difficulty is that the crimped strand tends to self-adhere and thereby to exhibit an expressively uniform or in-phase crimp configuration within the strand and also to acquire slubs as adjacent bights of strand co-adhere at occasional intervals.

A primary object of the present invention is enhanced uniformity of treatment in compressive crimping of textile strands.

Another object is compressive crimping of textile strands so as to reduce physical degradation thereof attributable to propulsion, impact, or other handling.

A further object is high-speed compressive crimping of textile strands applicable to strands comprising relatively narrow ribbons, strips, or tapes, whether prefibrillated or not, as well as to strands comprising one or more filaments.

Other objects of the invention, together with means for attaining the various objects, will be apparent from the following description and the accompanying diagrams.

FIG. 1 is a front elevation, partly diagrammatic, of apparatus to which the present invention is applicable.

FIG. 2 is a plan view through an apparatus component of FIG. 1 (with strand therein);

FIG. 3 is a fragmentary sectional elevation of the same apparatus component, taken at line III—III on the last preceding view;

FIG. 4 is a side sectional elevation of the same apparatus component, taken at line IV—IV on FIG. 1;

FIG. 5 is a bottom perspective view of an apparatus component useful as a dephaser and slub deterrent;

FIG. 6 is a sectional elevation through part of the component of FIG. 5 in operating juxtaposition to the apparatus of preceding views;

FIG. 7 is an end elevation of auxiliary apparatus components in operating position; and FIG. 8 is a plan view of the apparatus of FIG. 7.

In general, the objects of the present invention are accomplished, in lengthwise compressive crimping treatment of textile strands to impart a crimped configuration thereto, by propelling a crimpable textile strand, as by a propulsion fluid, continuously into a rotating cylindrical chamber and thereby forming it into crimped configuration, accumulating the crimped strand temporarily therein, and continuously removing crimped strand therefrom at the leading edge of the so supported accumulation between an edge of the chamber and an adjacent solid surface rotating therewith. The preferred embodiment of the latter means is a ring-shaped device flanged to fit in place into a central opening in an end of the chamber.

Before an account of the present invention, shown particularly in subsequent views, it is helpful to consider a type of apparatus with which the invention is especially useful. An embodiment of such apparatus appears in FIGS. 1 to 4.

FIG. 1 shows, partly in elevation and partly schematically, a frame supporting various apparatus components and with strand 11 being treated thereby. The strand is withdrawn from package 12 thereof on a support at one end of the frame. The strand passes in sequence through guide 13, around idler roll 14, and through the successive nips of metering rolls 17, 17' and 18, 18'. Rolls 17 and 18 are driven by belts 7 and 8 from pulleys (not shown) on shaft 9 of a motor 10. From the final roll nip the strand passes via guide 19 to a branch inlet of jet 20. The jet is supplied through a main inlet with propulsion fluid, as by pump 5, by way of interconnecting rigid and flexible lines designated generally as 6 and provided with pressure gauge 4. Fluid enters the main inlet tube and propels strand 11 from the branch inlet tube through the junction of the inlet tubes and out the outlet end. As shown in more detail in subsequent views, the exiting strand impinges forcibly against the flat lower surface of shallow cylindrical chamber 30, which is open centrally at the top and which has a foraminous cylindrical surface.

FIGS. 2 and 4 show cylindrical chamber 30 enlarged in scale as compared with FIG. 1 and in plan (partly cut away) and sectional elevation, respectively, and FIG. 3 shows a sectional detail thereof. Supported for rotation on vertical shaft 31, the cylindrical means comprises a shallow cylinder having flat impervious bottom wall 32 affixed to the shaft, cylindrical screen 33 joining the peripheral edge of the bottom wall and the peripheral edge of top wall 34, which has central opening 35 therein. The outlet tube of jet 20 extends into the shallow cylinder through the central opening in the top wall and terminates under the edge of that top wall and about midway of the cylinder depth at a substantial angle (here about 45°) to the flat lower wall and at an equivalent distance from screen 33, which forms the cylindrical wall. Crimped strand accumulation 11' (so designated to distinguish it from original strand 11) lies against the screen and between the adjoining portions of the top and bottom walls where it accumulates by reason of centrifugal force imparted to it by forcible crimping contact with the lower wall of the rotating cylinder.

As shown in FIG. 1, cylindrical chamber 30 is rotated by shaft 31 by bevel gearing 39 (only fragmentarily indicated) driven through belt 37 from a suitable drive pulley. Crimped strand 11'' (so designated to distinguish it from accumulation 11' thereof in the rotating cylindrical chamber as well as from the original strand) is withdrawn through central opening 35 in the top wall and passes about guide 41 and through stabilization chamber 40, which has entrance and exit openings to accommodate it. From the stabilization chamber it proceeds through guide 42, over windup roll 43, which may be slotted appropriately to traverse the strand, and onto package 44 carried on swing arm 45. The swing arm is biased from an alternative (shown in phantom) oblique position, useful for package removal, against stop 46 by weight 47 suspended on cable 48 passing over pulley 49 and secured to the top of the swing arm. The windup roll is driven by belt 3 from a similar drive pulley (not shown).

Operation of the underlying apparatus just described and illustrated is readily understood. The strand is withdrawn from the package or other suitable source by the metering rolls and forwarded thereby to the fluid jet. Suitable propulsion fluid, such as air compressed from the atmosphere, propels the strand through the jet and against the flat impervious lower surface of the rotating cylindrical chamber, the fluid dissipating principally through the apertures in the adjacent screen. The forcible impact of the strand so propelled causes it to buckle into crimped configuration. The crimped strand accumulation lies against the concave interior surface of the rotating screen, where it is retained, at least in part by centrifugal force, in the channel formed by the flat top and bottom walls and the cylindrical screen.

Inasmuch as the jet is fixed in position and the screen is rotating continuously, the accumulating crimped strand does not pile up on itself but progresses along the screen counter to the direction of rotation. The locus of impact of the strand is always near the trailing edge of such accumulation, while the leading edge thereof is something over a half circle away, where crimped strand is withdrawn from the accumulation thereof. The windup roll withdraws the crimped strand out from under the overhanging top wall of the cylindrical chamber, the locus of withdrawal being determined by the ratio of withdrawal to rotational speed and the ratio of withdrawal speed to the speed at which the untreated strand is metered into the crimping zone, as well as by the crimping characteristics of the strand material and also the fluid pressure and the flow rate and volume.

The various speed ratios normally are maintained fixed, as suggested by the drive belts shown on a common drive pulley, but suitable provision for adjusting such ratios as may be desirable is readily available in the form of continuously variable drive linkages as well as stepwise variable pairs of pulleys, etc. Of course, the speed at which the strand issues from the outlet end of the jet is considerably greater than the rotational speed of the cylindrical chamber at the locus of impact of the issuing strand against the impervious flat lower wall thereof, such as at least twice and preferably several times as great. The crimping itself reduces the effective overall length of the strand by a minor fraction in the range of at least about one tenth but less than five tenths, usually between two and three tenths. The windup speed is accordingly less than the supply (or propulsion) speed. The residual excess of supply speed over screen speed causes the strand to accumulate in the illustrated serpentine folds along the screen.

FIG. 5 shows, in perspective, apparatus useful with the foregoing apparatus according to this invention. Tension ring 51 has flat annular portion 52 and depending cylindrical flange 53 along the inner edge thereof bounding central opening 54. The maximum radial dimension of the flat annular portion approximates that of top wall 34 of the cylindrical chamber, while the minimum radial dimension of that portion and of the depending flange is somewhat less than that of wall 34, whereupon the ring is adapted to rest upon that wall with the ring flange depending into central opening 35 in the top wall of cylindrical chamber 30 as shown in the next view.

FIG. 6 shows, in fragmentary sectional elevation, tension ring 51 in operating juxtaposition to cylindrical chamber 30 as just described. Crimped strand 11'' is withdrawn over the inner edge of top wall 34, as previously shown, but now it passes in contact with the upper surface of that wall and with the lower surface of annular portion 52 of the tension ring resting thereon. This aids in dephasing adjacent filaments in a given bight or length of the strand and also assists in reduction or removal of slubs or tangled portions of the strand, thereby assuring its presentation in orderly fashion to the withdrawal or windup means. No attempt is made in this view or succeeding views to depict the crimped configuration of the strand being withdrawn, which does not become fully apparent until it is released from the tension of withdrawal or winding.

The tensioning means already described and illustrated is not the only device that will meet the requirements of this invention for slub elimination, but it is preferred for simplicity and effectiveness of construction and operation. In any event such a device rotates with the cylindrical chamber, lies closely adjacent to the open end wall thereof and is biased thereagainst—preferably by its own weight. Such device is readily removable therefrom to facilitate string-up and any necessary adjustment, cleaning, or maintenance.

FIG. 7 shows in elevation, and FIG. 8 in plan, auxiliary withdrawal means comprising pair of tapered rolls 61, 71 carried on their respective axles 62, 72 by suitable auxiliary frame means (not shown). Roll 61, preferably made of steel or similar metal, is driven by appropriate drive means (also not shown) at desired withdrawal speed. Roll 71, preferably made of rubber or resilient plastic composition, is undriven. As shown, the rolls are contiguous, with their corresponding sizes of ends mutually adjacent, and are oriented on axes in a plane substantially parallel to top wall 34 of the cylindrical means.

As shown more clearly in FIG. 8, the axis of driven roll 61 is substantially parallel to a tangent to the wall at its nearest approach thereto. The roll taper opposes the direction of rotation so that crimped strand is withdrawn at a rapid rate over the larger roll surface thereof upon displacement of the leading edge of the strand accumulation in that direction. It will be apparent that, contrariwise, if the leading edge is not carried so far in the direction of rotation, the crimped strand is withdrawn at a lower rate over the smaller roll surface, thereby stabilizing the location of the leading edge.

When used with the further windup apparatus shown in FIG. 1, these tapered rolls would precede guide 41 or (if such guide is not used) the next succeeding element in the windup path.

It will be understood that the strand to be treated, although perhaps most likely uncrimped, may have been crimped previously by any suitable method, whereupon the present treatment would superimpose a second crimp upon the first. For example, the strand may have been crimped previously by a twist (or false-twist) method and then be compressively crimped hereby, as suggested with illustration and description together with a conventional compressive or stuffer-crimping operation in my U.S. Pat. No. 2,972,798.

If of drawable composition, the strand often will have been drawn quite some time before being crimped. However, a drawing step may be performed immediately before crimping, as suggested with illustration and description of a conventional compressive or stuffer-crimping operation in my U.S. Pat. No. 3,462,814, which lists many drawable strand compositions suited to a draw-crimping operation. The strand may even be taken directly from extrusion to drawing and crimping, as suggested with illustration and description of a conventional stuffer-crimping operation in my U.S. Pat. No. 3,499,953. Draw-crimping according to the present invention is readily accomplished by driving the second set of metering rolls (18, 18') at a sufficiently higher surface speed than the first set (17, 17'), as in a ratio of 4:1, for example.

Thermoplastic textile strands usually may be drawn or crimped (or both) more readily by heating thereof before or at the time of assuming drawn or crimped configuration, as indicated in my aforementioned patents. When draw-crimped the strand preferably is not allowed to cool intermediately but is maintained at temperature conducive to crimping. Preheating to reach a desired strand-treating temperature is readily accomplished. The propulsion fluid used in the jet may be hot air or steam, for example, so as to heat the strand passing therethrough.

Stabilization of the strand in its acquired configuration, as in the mentioned chamber, also customarily involves heat and may involve hot rolls, radiant heating, or treatment with hot fluid (which may be supplied from the same source as the propulsion fluid, if desired), moist or dry, and may involve tension application. See, for example, the heat-relaxation disclosed in my U.S. Pat. No. 3,221,385, and as augmented by a cooling aftertreatment in my U.S. Pat. No. 3,561,082. Selection of suitable heating means, whether for pretreatment or posttreatment (or both), is well within the ability of persons ordinarily skilled in the art, and no such heating means is illustrated or further described here.

The present invention is adapted to operation at high speeds, such as upwards of a thousand yards per minute. Such speeds are more readily attainable than in conventional stuffer-box types of compressive crimping because of the readier entry and exit of the strand from the open-sided channel-shaped chamber disclosed here than possible in the more complete enclosure customarily employed. The resulting crimp level is very even, and no undesirable crimp diminution occurs during windup, which is readily accomplished at relatively low tension.

Although a specific embodiment of the invention has been illustrated and described, certain modifications have been suggested hereinabove. Additional modifications, such as addition, combination, or subdivision of parts or steps, or substitution of equivalents, may be made while retaining all or some of the advantages and benefits of the invention, which itself is defined in the following claims.

I claim:

1. Strand-crimping apparatus comprising a cylindrical strand-receiving chamber within which the strand undergoes sufficiently forcible lengthwise impact against a wall thereof to buckle it into crimped configuration, including a foraminous cylindrical wall and a pair of relatively flat walls parallel to one another and perpendicular to and flanking the foraminous cylindrical wall, one of the walls having a central opening therethrough, means for propelling a strand to be crimped into and means for withdrawing it crimped from the chamber through the opening, means for rotating the chamber about the axis thereof, and including also separable ring-shaped means adjacent the flat outside of the wall having the central opening therein and adapted to receive crimped strand therebetween in crimp-dephasing rubbing contact therewith upon withdrawal thereof from the chamber, wherein the strand-propelling means and strand-withdrawal means are adapted to forward the strand at relatively fast and slow rates, respectively, whereby the strand piles up temporarily in crimped form therebetween inside the chamber.

2. Strand-crimping apparatus according to claim 1, wherein the ring-shaped means is gravity-biased against the flat outside of the wall.

3. Strand-crimping apparatus according to claim 1, including means for centering the ring-shaped means relative to the central opening.

4. Strand-crimping apparatus comprising a cylindrical strand-receiving chamber within which the strand undergoes sufficiently forcible lengthwise impact against a wall thereof to buckle it into crimped configuration, including a foraminous cylindrical wall and a pair of relatively flat walls parallel to one another and perpendicular to and flanking the foraminous cylindrical wall, one of the walls having a central opening therethrough, means for propelling a strand to be crimped into and means for withdrawing it crimped from the chamber through the opening, means for rotating the chamber about the axis thereof, and including also separable ring-shaped means adjacent the flat outside of the wall having the central opening therein and adapted to receive crimped strand therebetween in crimpdephasing rubbing contact therewith upon withdrawal thereof from the chamber, the strand—propelling means and strand-withdrawal means being adapted to forward the strand at relatively fast and slow rates, respectively, whereby the strand piles up temporarily in crimped form therebetween inside the chamber, wherein the ring-shaped means comprises a flat ring having a circular flange along the inner edge thereof within the central opening, the radius of the ring-shaped means being less than the radius of the adjacent flat wall of the chamber, and the ring-shaped means rests on that wall of it own weight.

5. Strand-crimping apparatus according to claim 4, wherein the axis is substantially vertical.

* * * * *